US005407496A

United States Patent [19]

Stehle et al.

[11] Patent Number: 5,407,496

[45] Date of Patent: Apr. 18, 1995

[54] METHOD OF MANUFACTURING A GUIDE FOR DRIVEN CHAINS

[76] Inventors: Hans P. Stehle, Robert-Koch-Weg 13, 71364 Winnenden; Udo Bartmann, Linsenhof 3, 73663 Berglen, both of Germany

[21] Appl. No.: 182,762

[22] Filed: Jan. 14, 1994

[30] Foreign Application Priority Data

Jan. 15, 1993 [DE] Germany ..... 43 00 887.9

[51] Int. Cl.[6] ..... C21D 8/02

[52] U.S. Cl. ..... 148/522; 30/383; 76/112

[58] Field of Search ..... 148/522; 30/383, 384, 30/385, 386, 387; 76/112, 101.1

[56] References Cited

U.S. PATENT DOCUMENTS

| | | | |
|---|---|---|---|
| 3,241,228 | 3/1966 | Rayniak et al. | 30/383 |
| 3,758,347 | 9/1973 | Stalker | 148/522 |
| 3,858,321 | 1/1975 | Conaty | 30/383 |
| 4,641,432 | 2/1987 | Kume | 30/387 |

*Primary Examiner*—Richard O. Dean

*Assistant Examiner*—Sikyin Ip

*Attorney, Agent, or Firm*—Robert W. Becker & Associates

[57] ABSTRACT

A method for the production of a slideway-type guide for driven chains such as cutting chains includes the application of a wear-resistant hard metal alloy as a running surface to the slideway of the guide. A bar-shaped blank with a dentritic structure, made from the alloy, is produced to form the running surface, a suction casting process being used in particular for this purpose. The blank is treated by hot isostatic pressing with high pressure at a high temperature. This is followed by an annealing process over a number of hours, at the end of which the structure of the alloy is so altered that the previously acicular and, to some extent, lattice-type carbides are dispersed and converted to rounded and, to some extent, spheroidal bodies which are densely and evenly distributed throughout the alloy. The alloy thereby becomes highly wear-resistant. The bars are then shaped so as to fit onto the slideway, and are fixedly connected thereto.

32 Claims, No Drawings

METHOD OF MANUFACTURING A GUIDE FOR DRIVEN CHAINS

BACKGROUND OF THE INVENTION

This invention relates to a method for producing a slideway-type guide for driven chains, in which the guide is provided with an at least partly curved slideway on which the chain runs, and in which a running surface made of a wear-resistant hard metal alloy—particularly, a hard cobalt alloy—is applied to the slideway, at least where there is a direction-changing surface.

Driven chains are used in various fields of technology (e.g., traction mechanism, cutting chains and for many other purposes). For many applications, chains have to slide on a guide surface with a change in direction. Depending on the tension of the chain, and the power to be transferred or applied by the chain, the slideway of the guide is often subjected to great stress, which can result in considerable wear to the guide itself and to the links of the chain sliding on the guide. It is therefore customary to apply a wear-resistant hard metal alloy running surface to such highly stressed guides, particularly where they change direction. One of the hard cobalt alloys or nickel-based alloys of various compositions, known by the trade-name Stellite, can be used. Apart from cobalt itself, hard cobalt alloys also contain other metals, e.g., nickel and/or chromium, as well as other components. A basic nickel alloy is Stellite 453.

The structure of the Stellite alloy used for the running surface varies depending on the manufacturing process used to make the blanks for the running surfaces. If the blank is made from rolled sheet metal, it has a rolled structure containing individual spheroidal carbides, as a result of which the running surface can withstand Great forces, particularly compressive forces, without being damaged. These running surfaces are therefore highly wear-resistant, but are expensive to manufacture. It is more cost-beneficial to produce the blanks by continuous casting (strand casting) or suction casting, or by metal-powder injection molding or sintering of Stellite, in which case the blanks can be formed as round or flat, profiled bars. With this production process a dendritic structure or "weld structure" containing cavities and acicular (i.e., needle-like) carbides with a lattice structure is formed. After appropriate forming and bonding to the slideway, running surfaces formed from such blanks are also very wear-resistant as far as abrasion is concerned, but their structure cannot withstand high pressures. When the slideway is subjected to more or less perpendicular pressure, individual acicular carbides can break, and, when the slideway is in constant use, the acicular structure can be partially destroyed due to compressive stress, finally leading to breakouts in the running surface.

It is therefore an object of the present invention to provide a slideway-type chain guide produced economically and in such a way that the running surface is highly wear-resistant, even when subjected to high compressive stress.

SUMMARY OF THE INVENTION

The method of manufacturing a guide for driven chains according to the present invention is primarily characterized by the following steps:

producing a blank of the alloy in the shape of a bar with a dendritic lattice structure;

treating the blank simultaneously at a high temperature and a high pressure for eliminating cavities and other lattice defects;

annealing the blank for a period of time;

allowing the blank to cool;

shaping the blank at a suitable shaping temperature so as to correspond to a desired contour of the running surface; and fixedly connecting the blank to the slideway.

Preferably, the step of producing includes casting the blank from the alloy.

Advantageously, the step of producing includes suction casting the blank form the alloy.

Expediently, the step of producing includes sintering the blank from the alloy.

In another embodiment, the step of producing includes metal powder injection molding the blank from the alloy.

Preferably, the step of producing includes forming the blank in the form of a strand. The method then further comprises the step of cutting to length the strand after the steps of annealing and allowing to cool to form bars of a length that corresponds to a length of the running surface. Expediently, the step of forming the blank in the form of a strand includes profiling the strand so as to conform to guide members of the guide chain.

The step of producing includes forming the blank in the form of a strand. The method then further comprises the step of cutting to length the strand to form bars before the steps of annealing and allowing to cool. The step of forming the blank in the form of a strand includes profiling the strand so as to conform to guide members of the guide chain.

In a preferred embodiment of the present invention, in the step of treating the blank simultaneously at a high temperature and a high pressure, the high temperature is at least substantially 800° C. and the high pressure is at least substantially 1000 bar. Preferably, the high temperature is greater than 1000° C., and more preferred greater than 1200° C.

The step of treating the blank simultaneously at a high temperature and a high pressure expediently includes the step of generating the high pressure with a gaseous medium.

Preferably, the step of treating the blank is carried out for substantially one hour.

The step of annealing is advantageously carried out for substantially 6 to 8 hours, preferably at a temperature of substantially 1200° C.

Advantageously, the step of producing includes forming the blank as a bar having a rectangular cross-section.

In a preferred embodiment of the present invention, the step of producing includes suction casting the blank from the alloy in the form of a round bar. Advantageously, the method further comprises the step of mechanically forming the round bar to a profiled bar. The round bar is preferably mechanically formed to have a square cross-section.

The step of producing may include forming the blank as a profiled strand, preferably of a square cross-section.

In the step of shaping the blank the shaping temperature is at least substantially 600° C. Preferably, the shaping temperature is generated with electric current.

Preferably, the step of fixedly connecting the blank to the slideway includes welding the blank, preferably by laser welding.

The inventive method further comprises in a preferred embodiment the step of machining the slideway, after the step of fixedly connecting the blank to the slideway, for adapting the slideway to guide members of the chain. The step of machining may include a cutting process or a non-cutting process.

The step of machining expediently includes cutting a groove into the slideway.

The present invention is also concerned with the method of guiding a cutting chain or a saw chain of a chain saw or an inverted-tooth chain in a guide that has an at least partly curved slideway functioning as a slide rail or guide rail or direction-changing guide for the cutting chain/saw chain/inverted-tooth chain wherein the slideway has, at least in an area of changing direction, a running surface made of a wear-resistant hard metal alloy, wherein the guide is manufactured according to the method of the present invention.

Producing the blank from the alloy (Stellite) with a "weld-structure" or dendritic structure involves considerably less manufacturing expense than the process of rolling the alloy into sheets and subsequent stamping flat bars. The bars produced by e.g. casting can be rectangular in cross-section and can also be profiled so that their shape largely conforms to the intended shape of the future running surface. Cavities and other defects in the weld structure of the blanks (whether these are in strand form or in the form of bars cut from the strand) can be largely or completely eliminated by subjecting them simultaneously to high pressure and high temperature. Such processing of Stellite by high-temperature isostatic pressing is essentially known in the art. In the method according to the invention, this step is followed by a further method step, in which the material that has been treated in the above described manner is then annealed for a considerable time, for example, 6 to 8 hours. After cooling, the strand or bar has a structure in which the originally acicular carbides are molded and individualized so that they no longer form a coherent lattice. This structure is similar to a rolled structure with spheroidal inclusions, but the carbides are more uniformly and finely distributed so that higher wear-resistance is achieved, even when subjecting the material to compressive stress. In addition, the sliding properties of the running surface are improved. To apply the running surface to the surface of the guide, a bar of this material is subjected to shaping at a temperature corresponding to the ensuing shaping or bending operation to conforms the bar to the shape of the guide surface (running surface). For a direction-changing guide, the bar is bent to a U-shape, for example. Then this shaped workpiece is fixedly connected to the slideway; laser welding is a suitable method.

DESCRIPTION OF PREFERRED EMBODIMENTS

The method according to the invention will be described in more detail in the following with the aid of one specific example of an embodiment of the invention.

A hard cobalt alloy or nickel-based alloy such as those available on the market under the trade name Stellite is heated to melting point in a mold. The melt leaves the mold in the form of a strand through a mouthpiece with a rectangular cross-section. In the suction casting process, the molten mass is sucked by vacuum into glass tubes of a given length. The structure of a strand produced in this manner is dendritic and thus contains acicular carbides which are mostly connected to form a lattice structure. At the transition points between successive parts of the strand which have solidified at consecutive time intervals, the structure is distinctly irregular. The strand contains notchlike indentations at these points. In addition, there are irregularly distributed pores in the structure of the material. The quadrangular (rectangular) strand has a cross-section of, for example, 4.8×3 mm, corresponding approximately to the cross-section of the mouthpiece of the mold. The mouthpiece can also be designed such that the strand has a particular profile, e.g. a longitudinal groove in one of its four longitudinal faces.

It is also possible to produce a suitable strand by the continuous casting process.

The suction casting process allows for manufacturing individual bars in which case a rod with a round cross-section is normally produced. In this case the rod is machined by cutting to produce a bar suitable for use as the running surface.

The strand produced by the suction casting process, after solidification and cooling, is cut into bars of the right length for the running surface of the slideway of the guide.

The bars are then introduced into a chamber for isostatic pressing. A gas pressure of approximately 1000 bar is produced in this chamber. The bars are heated at this pressure to a temperature of approximately 1200° C. This treatment is carried out for about one hour. After this, the bars are annealed. This can be done in the same chamber. However, for cost reasons it is preferred to use a second oven for this purpose because the bars do not need to be subjected to pressure during annealing. The high pressure chamber, which is expensive to build and maintain, will then be available for the next batch of bars. The annealing of the bars lasts for about 6 to 8 hours. The annealing temperature is approximately 1200° C.

It is also possible to produce a longer strand by high-temperature isostatic pressing, followed by annealing and cooling, after which individual bars are cut to length from the strand.

After the material of the bars or strand has been heat-treated under pressure, followed by annealing, its structure is altered such that it is exceptionally dense; its pores, cavities, and other defects have almost completely disappeared, and the needle-like (acicular) carbides have largely been dispersed and converted to rounded, partly spheroidal bodies.

If the slideway that is to be provided with a wear-resistant running surface is curved, it will be necessary to bend the respective bar for this purpose. In many cases, only the direction-changing regions of such a guideway have to be covered with a wear-resistant running surface, for example, direction-changing guides for cutting chains or the guide rails of saw chains such as those provided on motor chain saws. The bars are therefore subjected to appropriate shaping to adapt them to the contour of the head part of the slide rail or guide rail. For this purpose, the individual bar is heated to a temperature of at least approximately 600°. This can conveniently be done by electric current. During this process the bar is bent around the head of the rail, so that it sits snug against the narrow side of the rail. Then the bar is welded onto the narrow side of the rail, preferably by laser welding. However, other welding processes known in the art can be used for this purpose, for example, electric welding or inert gas welding. If an indentation is required in the slideway as a lateral guide for the chain, a circumferential groove can be machined (cut) into the narrow side of the rail; this groove then runs at a uniform depth along the perimeter of the rail and the running surface. In this case it is particularly expedient that the bar for forming the running surface be preshaped to a suitable profile during casting.

For the production of these bars, it is also possible to produce a strand by sintering or metal-powder injection molding instead of using the continuous casting method or the suction casting method.

The present invention is, of course, in no way restricted to the specific disclosure of the specification and drawings, but also encompasses any modifications within the scope of the appended claims.

What is claimed is:

1. A method of manufacturing a guide for driven chains, wherein the guide has an at least partly curved slideway for the chain and wherein the slideway has, at least in an area of changing direction, a running surface made of a wear-resistant hard metal alloy, said method comprising the steps of:

producing a blank of the alloy in the shape of a bar with a dendritic lattice structure;

treating said blank simultaneously at a high temperature and a high pressure with a gaseous medium for eliminating cavities and other lattice defects;

immediately thereafter, changing the dendritic lattice structure of the alloy into a structure having dispersed individual spheroidal carbides similar to a rolled structure by annealing said blank for a period of time of at least 6 hours;

allowing said blank to cool;

shaping said blank at a suitable shaping temperature so as to correspond to a desired contour of the running surface; and fixedly connecting said blank to the slideway.

2. A method according to claim 1, wherein said step of producing includes casting said blank from the alloy.

3. A method according to claim 1, wherein said step of producing includes suction casting said blank form the alloy.

4. A method according to claim 1, wherein said step of producing includes sintering said blank from the alloy.

5. A method according to claim 1, wherein said step of producing includes metal powder injection molding said blank from the alloy.

6. A method according to claim 1, wherein said step of producing includes forming said blank in the form of a strand, and further comprising the step of cutting to length the strand, after said steps of annealing and allowing to cool, to form bars of a length that corresponds to a length of the running surface.

7. A method according to claim 6, wherein said step of forming said blank in the form of a strand includes profiling said strand so as to conform to guide members of the driven chain.

8. A method according to claim 1, wherein said step of producing includes forming said blank in the form of a strand, and further comprising the step of cutting to length the strand to form bars before said steps of annealing and allowing to cool.

9. A method according to claim 8, wherein said step of forming said blank in the form of a strand includes profiling said strand so as to conform to guide members of the driven chain.

10. A method according to claim 1, wherein in said step of treating said blank simultaneously at a high temperature and a high pressure said high temperature is at least substantially 800° C. and said high pressure is at least substantially 1000 bar.

11. A method according to claim 10, wherein said high temperature is greater than 1000° C.

12. A method according to claim 11, wherein said high temperature is greater than 1200° C.

13. A method according to claim 1, wherein said step of treating said blank simultaneously at a high temperature and a high pressure includes generating said high pressure with a gaseous medium.

14. A method according to claim 1, wherein said step of treating said blank is carried out for substantially one hour.

15. A method according to claim 1, wherein said step of annealing is carried out for substantially 6 to 8 hours.

16. A method according to claim 1, wherein said step of annealing is carried out at a temperature of substantially 1200° C.

17. A method according to claim 1, wherein said step of producing includes forming said blank as a bar having a rectangular cross-section.

18. A method according to claim 1, wherein said step of producing includes suction casting said blank from the alloy in the form of a round bar, and further comprising the step of mechanically forming the round bar to a profiled bar.

19. A method according to claim 18, wherein the round bar is mechanically formed to have a square cross-section.

20. A method according to claim 1, wherein said step of producing includes forming said blank as a profiled strand.

21. A method according to claim 20, wherein the profiled strand has a square cross-section.

22. A method according to claim 1, wherein in said step of shaping said blank said shaping temperature is at least substantially 600° C.

23. A method according to claim 1, wherein said step of shaping said blank includes heating said blank to said shaping temperature with electric current.

24. A method according to claim 1, wherein said step of fixedly connecting said blank to the slideway includes welding the blank.

25. A method according to claim 24, wherein said step of welding is performed by laser welding.

26. A method according to claim 1, further comprising the step of machining the slideway, after said step of fixedly connecting the blank to the running surface, for adapting the slideway to guide members of the chain.

27. A method according to claim 26, wherein said step of machining includes a cutting process.

28. A method according to claim 26, wherein said step of machining includes a non-cutting process.

29. A method according to claim 26, wherein said step of machining includes cutting a groove into the slideway.

30. A method of guiding a cutting chain in a guide that has an at least partly curved slideway as a slide rail for the cutting chain wherein the slideway has, at least in an area of changing direction, a running surface made of a wear-resistant hard metal alloy, wherein the guide is manufactured according to the method of claim 1.

31. A method of guiding a saw chain in a guide that has an at least partly curved slideway as a guide rail for the saw chain wherein the slideway has, at least in an area of changing direction, a running surface made of a wear-resistant hard metal alloy, wherein the guide is manufactured according to the method of claim 1.

32. A method of guiding an inverted-tooth chain in a guide that has an at least partly curved slideway as a direction-changing guide for the inverted-tooth chain wherein the slideway has, at least in an area of changing direction, a running surface made of a wear-resistant hard metal alloy, wherein the guide is manufactured according to the method of claim 1.

* * * * *